US005645023A

United States Patent [19]

Regueiro

[11] Patent Number: 5,645,023

[45] Date of Patent: Jul. 8, 1997

[54] VALVE TRAIN FOR AN INTERNAL COMBUSTION ENGINE

[75] Inventor: Jose F. Regueiro, Rochester Hills, Mich.

[73] Assignee: Chrysler Corporation, Auburn Hills, Mich.

[21] Appl. No.: 629,161

[22] Filed: Apr. 8, 1996

[51] Int. Cl.[6] ..... F01L 1/26

[52] U.S. Cl. ..... 123/90.27; 123/90.22; 123/90.5

[58] Field of Search ..... 123/90.22, 90.23, 123/90.27, 90.39, 90.4, 90.41, 90.44, 90.48, 90.5

[56] References Cited

U.S. PATENT DOCUMENTS

| | | | |
|---|---|---|---|
| 4,558,667 | 12/1985 | Inagaki et al. | 123/90.44 |
| 4,617,881 | 10/1986 | Aoi et al. | 123/90.27 |
| 4,686,945 | 8/1987 | Inagaki et al. | 123/90.22 |
| 4,850,311 | 7/1989 | Sohn | 123/90.18 |
| 5,095,858 | 3/1992 | Ascari | 123/90.27 |
| 5,150,672 | 9/1992 | Fischer et al. | 123/90.27 |
| 5,211,143 | 5/1993 | Fontichiaro et al. | 123/90.18 |
| 5,303,680 | 4/1994 | Nielsen | 123/90.22 |
| 5,347,964 | 9/1994 | Regueiro | 123/90.22 |
| 5,501,187 | 3/1996 | Speil et al. | 123/90.22 |
| 5,535,710 | 7/1996 | Zoschke et al. | 123/90.27 |
| 5,542,315 | 8/1996 | Carroll, III et al. | 123/90.48 |
| 5,570,665 | 11/1996 | Regueiro | 123/90.27 |

*Primary Examiner*—Weilun Lo
*Attorney, Agent, or Firm*—Kenneth H. MacLean

[57] ABSTRACT

A valve train mechanism for an internal combustion engine that includes angulated intake valves and exhaust valves extending from an upper wall of the combustion chamber and having an actuator provided with a spherical joint connection for directly actuating inverted bucket tappets associated with the intake and exhaust valves.

2 Claims, 6 Drawing Sheets

FIG-13
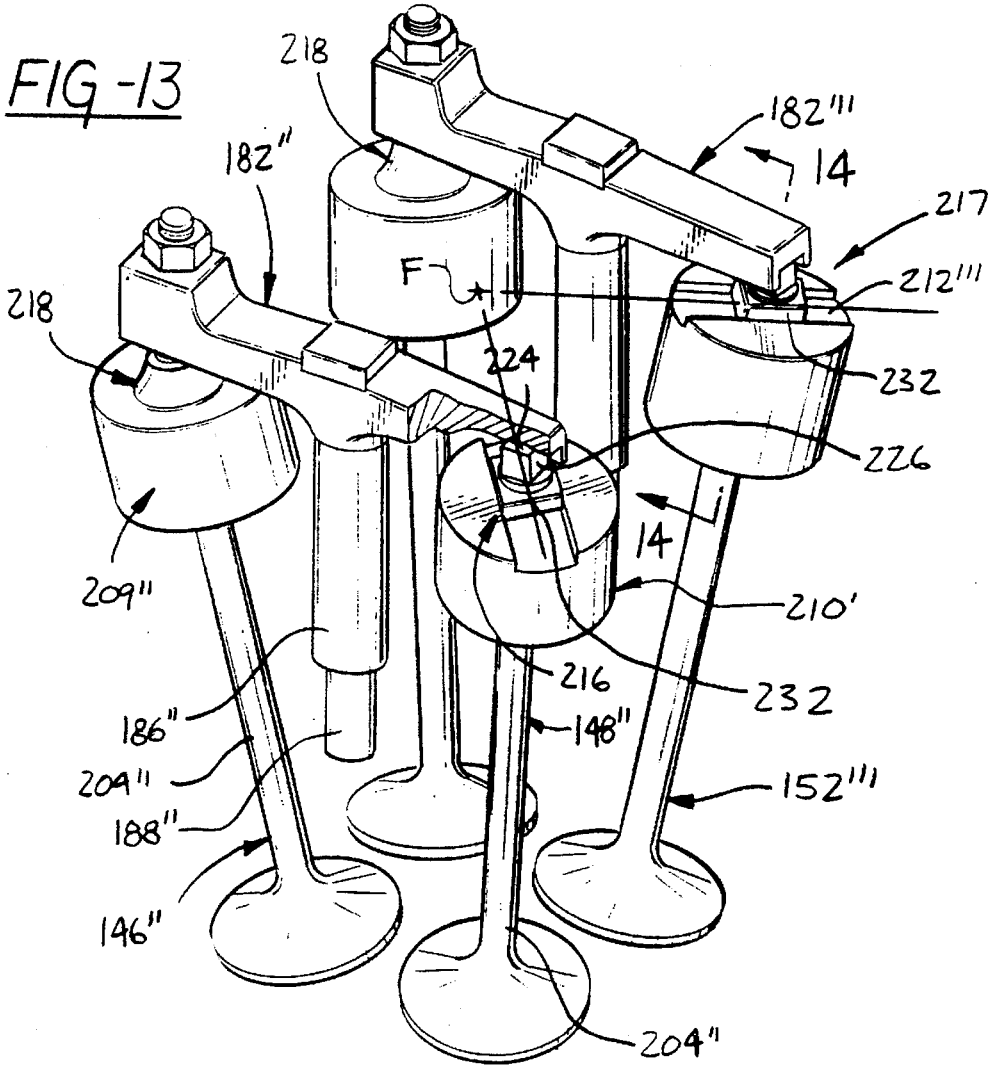
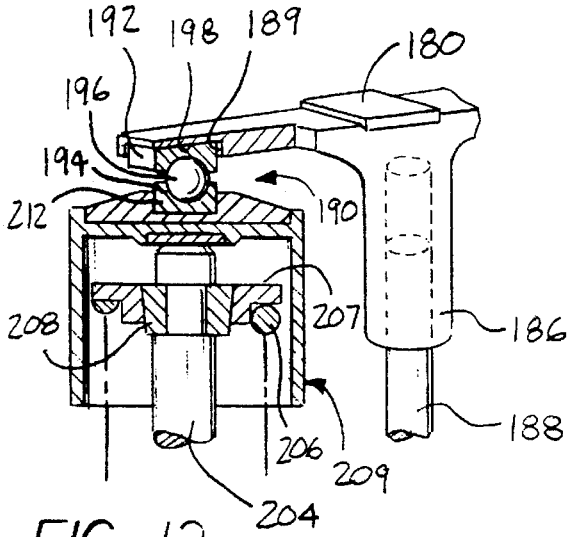
FIG-12
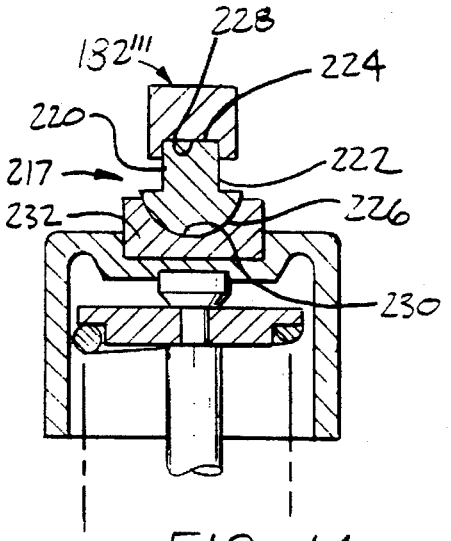
FIG-14

VALVE TRAIN FOR AN INTERNAL COMBUSTION ENGINE

FIELD OF THE INVENTION

This invention concerns internal combustion engines and, more particularly, relates to an engine valve train mechanism with angulated intake valves and exhaust valves extending from a curved upper wall of the combustion chamber and having actuators for actuating the intake and exhaust valves through spherical joints.

BACKGROUND OF THE INVENTION

In the past, there have been various forms of valve trains proposed for multi-valve engines. One example can be seen in my U.S. Pat. No. 5,347,964, issued on Sep. 20, 1994 and entitled "Valve Train For Internal Combustion Engines". In this patent, I disclose a four-valve, double-overhead camshaft valve train in which the axes of the valves for each cylinder diverge outwardly from and are non-parallel with respect to the axis of the cylinder. The valve mechanism has a finger follower for each camshaft lobe and valve and a contact pad between the cam and the finger follower to permit rocking movement so that the orientation of the finger follower and the axis of the valve remain at a fixed relationship.

Also, in my U.S. patent application Ser. No. 08/416,245 filed on Apr. 4, 1995, and entitled "Valve Train For Internal Combustion Engine", I disclose a valve train utilizing an inverted bucket tappet with a slide and spherical joint structure operatively disposed between the bucket and the end of the valve stem allowing the valves to be angulated with respect to each other and to the axis of the cylinder in both the transversal and horizontal planes of the engine.

Another example of a valve train that can be used in a multi-valve engine can be seen in my co-pending U.S. patent application Ser. No. 08/578,369, filed on Dec. 26, 1995 and entitled "Valve Train for an Internal Combustion Engine". The valve train mechanism disclosed in this patent application is based on the use of a cross member, which as seen in one embodiment of the invention takes the form of a guided "T" bridge, and which serves to directly actuate an inverted bucket tappet through a roller and groove connection without any side thrust on the valve stem. In alternate embodiments disclosed in this particular application, the cross member is designed so that it can be stable without having a pin to guide movement as provided in the "T" bridge.

In addition, U.S. Pat. No. 4,558,667, issued on Dec. 17, 1985 in the name of Inagaki et al. and entitled "Valve Driving Apparatus For An Internal Combustion Engine", discloses a valve driving apparatus incorporated in an internal combustion engine that has plural valve stems in a cylinder head that are aligned radially about the cylinder with the intersection of their longitudinal axes substantially coinciding with a center of curvature of an upper wall surface of the combustion chamber. The valve stems are arranged so as to be driven by at least one camshaft through subsidiary rocker arms which are in abutment with respective tips of the valve stems and respective rocker arms which are in abutment with the subsidiary rocker arms. The valve train is characterized in that a shaft for each of the subsidiary rocker arms is positioned on a plane crossing a longitudinal axis of the corresponding one of the valve stems at a right angle and existing in a range of up-and-down stroke of the head of the same valve stem.

Another patent disclosing a valve train for a multi-valve engine is the U.S. Pat. No. 4,617,881, issued on Oct. 21, 1986 in the name of Aoi et al., and entitled "Actuating Mechanism For Multiple Valve Internal Combustion Engine". In this instance, there are two embodiments of valve arrangements that permit the use of a plurality of valves for a given combustion chamber while operating all of the valves through a camshaft arrangement. Some of the valves are operated directly by the cam lobes and others are operated by rocker arms. In addition, an embodiment discloses a two rocker arm arrangement for operating certain valves.

A still further disclosure of a valve train for a multi-valve internal combustion engine can be seen in U.S. Pat. No. 4,686,945, issued on Aug. 18, 1987 in the name of Inagaki et al., and entitled "Valve Structure For An Internal Combustion Engine". This patent shows an engine employing multiple valves which are mutually inclined. The valve actuating assembly disclosed includes two camshafts with primary rocker arms being driven by the camshafts and, in turn, drive secondary rocker arms. The secondary rocker arms are pivotally mounted about common shafts and extend to the valves. The common shafts are located between the valves.

SUMMARY OF THE INVENTION

The valve train mechanism according to the present invention is functionally similar to each of the valve trains described above in that it serves to actuate the valves of an engine. However, the valve train according to this invention differs structurally from the above-described arrangements in that it serves to directly actuate an inverted bucket tappet through a spherical joint without any side thrust on the valve stem such as can occur in the valve train mechanisms shown in the above-mentioned patents to Inagaki et al., Aoi et al., in my '964 patent mentioned above, and in my patent application Ser. No. 416,245 also mentioned above. Moreover, the mechanism according to the present invention can be designed to operate either one single valve per rocker arm or two. When two valves are operated, it is done by the use of a crosshead which can be guided or unguided. These mechanisms allow the valves to be operated without side thrust on the valve stem, and to do so they require inverted bucket tappets. In addition, these mechanisms all have sliding and can have rotating motions between the actuator, be it a finger follower, a rocker arm or cross member, and the inverted bucket tappet. The rotating motion is provided by the use of spherical joints through the use of a half ball, a full ball or an encapsulated half ball which at times is referred to as "an elephant foot". The sliding motion can be provided by a shoe associated with the ball portion of the spherical joint. As an alternative, the half ball can have the flat surface thereof serve to provide the sliding connection with the actuator. All of the sliding motions have large surface areas between the contact members. Accordingly, to minimize wear there are no "single point" or "line" contacts.

More specifically, the valve train mechanism made in accordance with the present invention is incorporated in a cylinder head of an internal combustion engine having essentially hemispherical combustion chambers each of which has four valves, the valve stems axes of which are essentially normal to the upper hemispherical surface of the combustion chamber. One version of the valve train mechanism utilizes an in-head camshaft to operate the rocker arms. In another version of the valve train mechanism, an in-block camshaft with regular tappets and push rods serves to operate the rocker arms. In both cases, the rocker arms can actuate the valves through a cross member. In addition, the present invention is based on the combination of inverted bucket tappets inserted in between the rocker arm, finger follower, or the cross member and the valves, spherical joints at the end of the rocker arm, finger follower, or cross member contacting the tappets and, in the case of the four valve arrangement, grooves formed in the tappets or special shims on the tappets grooved to guide the cross member and prevent it from rotating about its support axis. The rocker arm, finger follower, or cross member oscillates about a vertical plane which is transversal to the crankshaft centerline, and the intake valves and the exhaust valves operate on a plane transversal to the engine and also angled in the longitudinal plane with respect to the crankshaft centerline. Valve lash calibration can be realized by thickness-selectable elements on one of the valves or by an adjustment screw at the valve-end of the actuator.

Stated broadly, the new and improved valve train mechanism made in accordance with the present invention is incorporated in an internal combustion engine having a cylinder head fixedly mounted on an engine block provided with one or more cylinders each of which has a piston reciprocally supported therein along the axial center line of the associated cylinder. An essentially hemispherical combustion chamber is provided in each of the cylinders of the engine and is defined by a recess in the cylinder head and the top of the piston. At least a pair of valves are located in the cylinder head and each of the valves is inclined outwardly from the combustion chamber at substantially equi-angular orientation relative to the axial center line of the cylinder. An inverted bucket tappet is mounted in the cylinder head for reciprocal movement and is operatively associated with each of the valves at the upper end thereof. An actuator in the form of a rocker arm, cross member, finger follower, or the like is provided for moving each of the valves to an open position. In addition, a ball member and a socket member provide a ball and socket connection located between the actuator and the top of the inverted bucket tappet. Also, a sliding connection is provided between the actuator and the inverted bucket tappet for cooperation with the ball and socket connection for assuring that the arm maintains a force-applying connection with the inverted bucket tappet as the actuator moves the valve from the closed position to the open position.

BRIEF DESCRIPTION OF THE DRAWINGS

The above and other features, objects and advantages of the present invention will be more apparent from the following detailed description when taken with the drawings in which:

FIG. 12 is a view partially in section showing in more detail a portion of the crosshead and one of the spherical joints seen in the valve train mechanism of FIG. 9;

FIG. 13 is an isometric view of a valve train mechanism similar to that seen in FIGS. 8–12 but provided with different types of spherical joints, and FIG. 14 is an enlarged sectional view of one of the spherical joints employed with the valve train mechanism seen in FIG. 13 and taken on line 14—14 of FIG. 13.

DETAILED DESCRIPTION OF THE DRAWINGS

Figure 1:
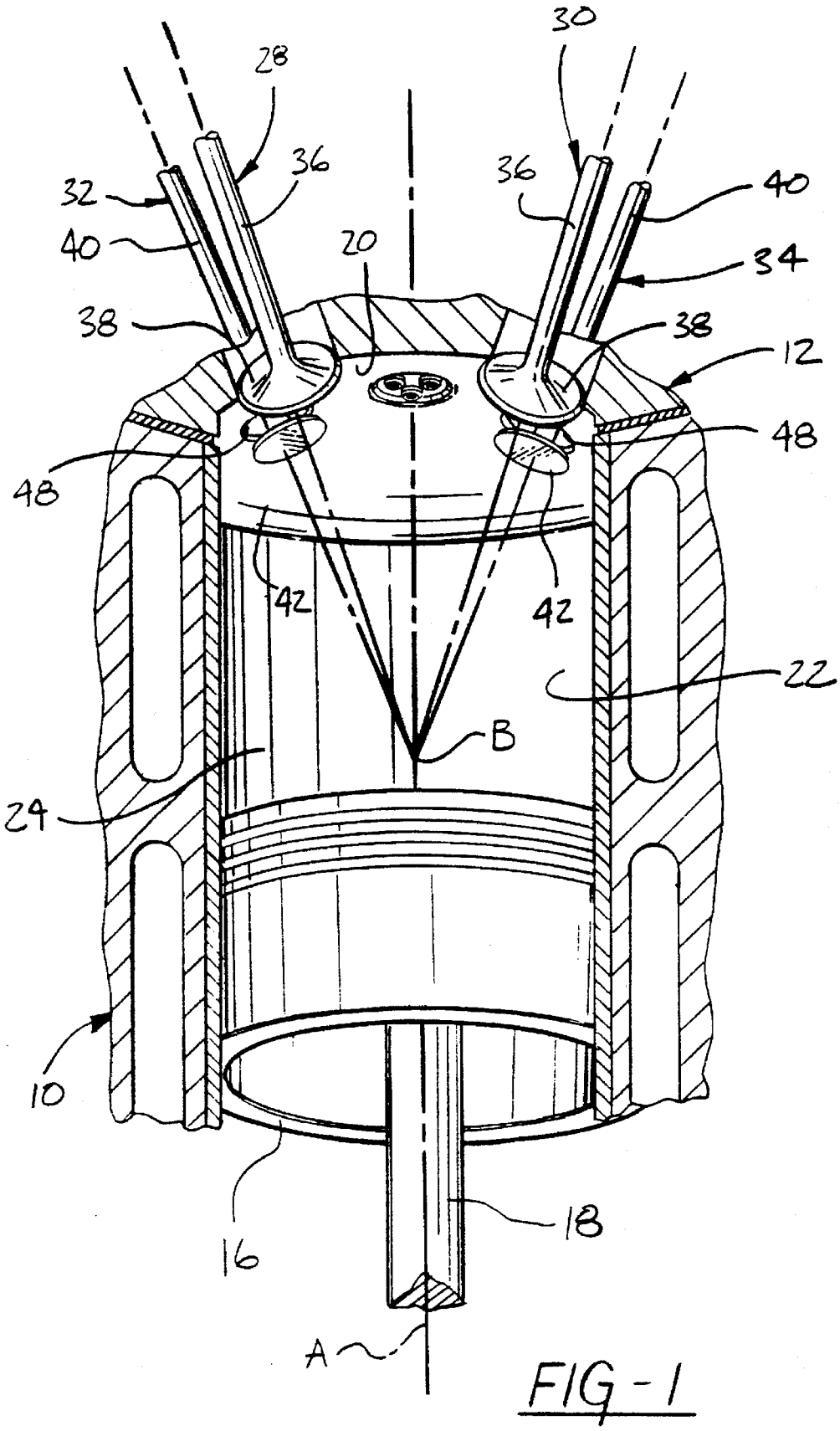
FIG. 1 is a perspective side view of one cylinder of a multi-cylinder engine showing a pair of intake valves and a pair of exhaust valves actuated by a valve train mechanism made according to the present invention and seen in FIG. 2.
Figure 2:
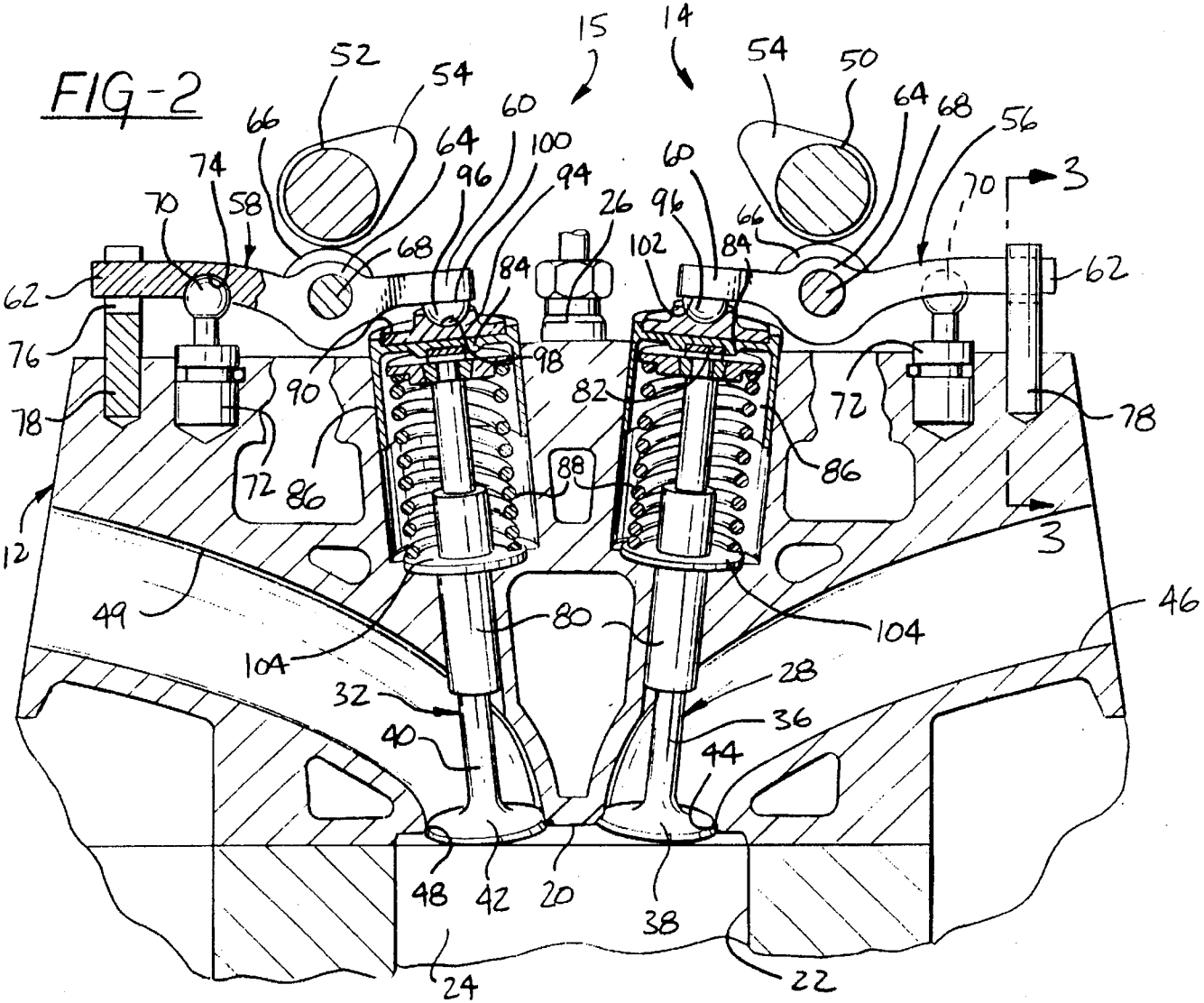
FIG. 2 is a view partially in section of a portion of the cylinder head incorporating the intake valves of FIG. 1 and one embodiment of a valve train mechanism for actuating the valves in accordance with the present invention.

Referring now to the drawings and more particularly to FIG. 1 thereof, a perspective view of a single cylinder of a multi-cylinder engine is shown having an engine block 10 on which is secured by fasteners (not shown) a lower portion of a cylinder head 12 that incorporates a pair of identical valve train mechanisms 14 and 15 made in accordance with the invention and seen in FIG. 2.

Each of the cylinders of the engine house a piston 16 which moves axially along the longitudinal center axis A of the associated cylinder and has the lower end thereof connected to the engine crankshaft (not shown) by a connecting rod 18. The cylinder head 12 is formed with a hemispherical surface 20 providing a recess which is aligned with the bore defining the associated cylinder 22 and together with the top of the piston 16 form a combustion chamber 24 which varies in volume during the operation of the engine. In this instance, a fuel injector 26, the type which is seen in FIG. 2, is threadably secured in the cylinder head 12 centrally of the hemispherical surface or recess 20 along the longitudinal axis "A" of each cylinder 22. As will become apparent as the description of the present invention proceeds, the valve train mechanisms 14 and 15 according to the present invention can also be used with a spark ignition internal combustion engine.

As best seen in FIGS. 1 and 2, the cylinder head 12 is provided with a pair of intake valves 28 and 30 and a pair of exhaust valves 32 and 34 which are located in side-by-side relationship. Each of the intake valves 28 and 30 has a valve stem 36 the lower end of which is formed with a round valve head 38. Similarly, each of the exhaust valves 32 and 34 has a valve stem 40 the lower end of which is formed with a round valve head 42. As is conventional, each of the intake valve heads 38 is normally seated in a valve seat formed in the cylinder head that defines a round opening or port 44 of an intake passage 46 formed in the cylinder head 12 as seen in FIG. 2. Also, each of the exhaust valve heads 42 are normally seated in a valve seat formed in the cylinder head 12 that defines a round opening or port 48 of an exhaust passage 49 formed in the cylinder head 12.

It will be noted that the valve stems 36 of the intake valves 28 and 30 and the valve stems 40 of the exhaust valves 32 and 34 are disposed radially about the cylinder head 12 such that the intersection of their longitudinal center axes may occur as shown in FIG. 1 at a point "B" substantially located on the longitudinal center axis of the cylinder 22. As a result, the centers of the valve heads 38 of the intake valves 28 and 30 and the centers of the valve heads 40 of the exhaust valves 32 and 34 may be located on a common circle concentric with the periphery of the cylinder 22. In addition, in this case, the centers of the valve heads 38 and 42 are circumferentially equally spaced from each other. Also, each of the valve heads 38 and 42 is in an essentially tangential plane relative to the hemispherical recess 20. Thus, as seen in FIG. 1, the longitudinal centerline of each valve 28–34 may be canted at an equal angle to both the longitudinal and transversal planes of the engine. This orientation not only allows for more room at the top of the cylinder 22 and lessens the space requirements for valves, spark plugs, injectors, prechambers or cooling water jackets, but also produces a far superior combustion chamber with optimum central location of the spark plug or injector.

In order to simplify the description of the invention, the valve train mechanism 14 is shown in FIG. 2 employed with one of the intake valves 28 and the other valve train mechanism 15 is shown employed with one of the exhaust valves 32 of the engine seen in FIG. 1. It will be understood that essentially identical valve train mechanisms would be employed with the intake valve 30 and the exhaust valve 34 located to the rear of valves 28 and 32, respectively, for opening and closing the associated ports. Moreover, inasmuch as the engine block and the various operating components normally associated therewith are well known to those skilled in the art of engine design, a detailed showing and/or description of such parts and components is not being provided herein. Instead, the valve train mechanisms 14 and 15, will now be described in detail.

As seen in FIG. 2, a pair of laterally spaced overhead camshafts 50 and 52 are rotatably supported in the upper portion of the cylinder head 12 by a camshaft base and camshaft cap (neither of which are shown) which are secured by cap screws (not shown) in threaded holes disposed in the lower head portion of the cylinder head 12. Each of the camshafts 50 and 52 is supported for rotation about an axis that is substantially parallel to the rotational axis of the engine crankshaft and each camshaft 50 and 52 includes a plurality of cam lobes, (one of which is only shown and identified by reference numeral 54) for actuating the valves 28 and 32 through actuator arms or finger followers 56 and 58.

Figure 3:
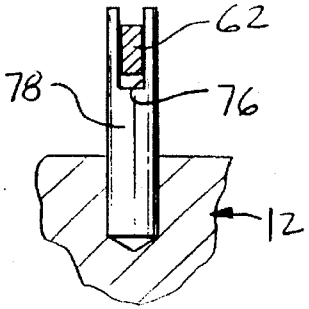
FIG. 3 is a sectional view taken on line 3—3 of FIG. 2.

In this regard, the finger followers 56 and 58 are identical in construction and each is formed as an elongated member having a head end 60 and a tail end 62 with an enlarged portion 64 intermediate the two ends that is provided with a roller 66 supported for rotation about a shaft 68 fixed to the body of the associated finger follower and providing rotation of the roller 66 about an axis parallel to the rotational axis of the camshafts 50 and 52. In addition, each finger follower 56 and 58 is adapted to pivot about the ball portion 70 of a conventional hydraulic lash compensator 72 which is slidably disposed in the cylinder head 12. The ball portion 70 is received by a spherical recess 74 formed in the finger follower body between the roller 66 and the tail end 62 of the finger follower 56. In order to assure that each finger follower 56 and 58 will pivot about the ball portion 70 along a plane perpendicular to the rotational axes of the camshafts 50 and 52, the rectangularly shaped tail end 62 of each finger follower 56 and 58 is located within a slot 76 formed in a guide member 78 fixed with the cylinder head 12 as seen in FIG. 3.

Both the intake valve 28 and the exhaust valve 32 have their respective stems 36 and 40 extending upwardly from the valve head and passing through a guide sleeve 80 secured to the cylinder head 12. The flat upper end of each stem 36 and 40 abuts a flat anti-friction disc 82 which is disposed inside an associated inverted bucket tappet. Each inverted bucket tappet comprises a circular roof portion 84 integral with a cylindrical skirt 86 and is slidably mounted within the cylinder head 12 for linear reciprocal movement along an axis parallel or coaxial with the valve axis and against the bias of a compression spring 88, the upper end of which abuts a retainer secured to the upper end of the valve stem by a conventional two-piece lock. The top surface of the roof portion 84 of each inverted bucket tappet is formed with a circular cavity 90 in which one part of a spherical joint is located.

In this regard, each spherical joint consists of a socket member 94 and a half-ball 96. The socket member 94 takes the form of a disc with a centrally located spherical recess 98 formed in the top surface of the socket member 94. Also, the socket member 94 is sized so that it fits within the cavity 90 formed in the roof portion 84 of the associated inverted bucket tappet. The half-ball 96 has a spherical outer surface which is complementary in shape with the spherical recess 98 and is in surface-to-surface contact therewith. The half-ball 96 also has a flat outer surface 100 which abuts the flat lower surface 102 of the head end 60 of the associated finger follower. The surface 102 of each finger follower is located in a plane which can be substantially parallel to a plane passing through the rotational axes of the camshafts 50 and 52 as shown in the drawings.

It will be noted that the lower end of each compression spring 88 is seated on a washer 104 disposed in a conventionally spot-faced recess formed in the lower head portion of the cylinder head 12. Thus, it should be apparent that the intake valve 28 and the exhaust valve 32 are normally maintained in the closed position shown by the associated compression spring 88. In addition, the fuel injector 26 is secured to the cylinder head 12 and is positioned centrally relative to the intake valves 28, 30 and the exhaust valves 32, 34. As aforementioned and as seen in FIG. 1, the angles of inclination of the intake valves 28, 30 and the exhaust valves 32, 34 are equal with respect to the horizontal and transversal planes, and their axes all converge at a point B low in the centerline of the cylinder 22. By having the valves 28–34 angled outwardly from the combustion chamber 24, a truncated space is provided which may allow a precombustion chamber (not shown) to be positioned adjacent the combustion chamber 24. This increased space also provides clearance for a glow plug (not shown) within the precombustion chamber 106.

In operation, the rotation of the camshaft 50 serves to actuate the finger follower 56 which, in turn, depresses the associated inverted bucket tappet. This occurs as the cam lobe 54 of the camshaft 50 strokes the roller 64 of the finger follower 56 causing the head end 60 thereof to pivot downwardly about the ball portion 70 under the guidance of the guide member 78. The downward movement of the head end 60 of the finger follower 56 causes the intake valve 28 to be opened so as to allow communication between the intake passage 46 and the combustion chamber 24 via the port 44. As the inverted bucket tappet associated with the intake valve 28 moves downwardly under the urging of the finger follower 56, the socket member 94 experiences a compound motion. That is, due to the inclination of the intake valve 28 as explained above, the socket member 94 moves downwardly along the longitudinal center axis of valve stem 36 and simultaneously moves radially inwardly towards the center of the cylinder. At the same time, the head end 60 of the finger follower 56 moves in a plane which is perpendicular to a plane passing through the rotational axes of the camshafts 50 and 52. The spherical joint composed of the socket member 94 and the half-ball 96 serves to compensate for this difference in motion of the inverted bucket tappet and the finger follower 56. What occurs is that as the head end 60 of the finger follower 56 moves downwardly, the half-ball 96 is able to swivel relative to the socket member 94. In addition, inasmuch as the flat surface 100 of the half-ball 96 is in surface-to-surface engagement with the flat surface 102 of the head end 60 of the finger follower 56, there is relative sliding movement between the two. Thus, in this manner, the spherical joint between the head end 60 of the finger follower 56 and the associated inverted bucket tappet allows the intake valve 28 to move along an inclined axis while the finger follower 56 moves in the transversal plane of the engine 10.

Inasmuch as the valve train mechanism 15 is a mirror image of the valve train mechanism 14, it will be understood that rotation of the camshaft 52 results in the same operation of the finger follower 58 and movement of the exhaust valve 32 as described above in connection with the valve train mechanism 14 and therefore needs not to be repeated herein.

Figure 4:
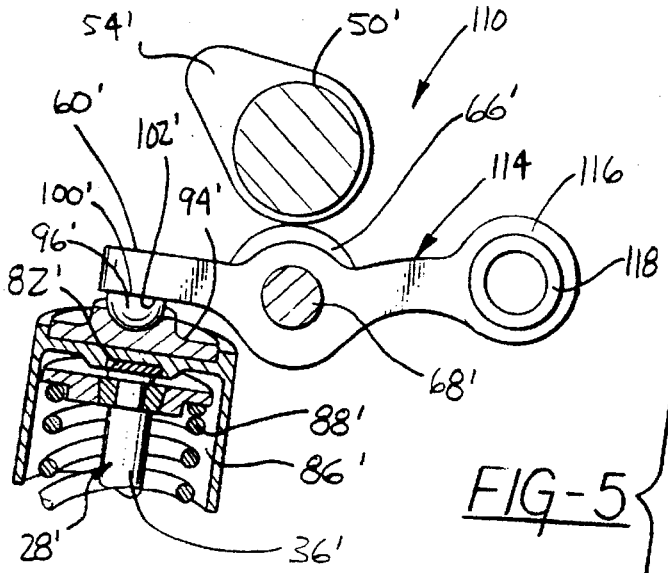
FIG. 4 is a view of another type of rocker arm that can be used in the valve train mechanism shown is FIG. 2.
Figure 5:
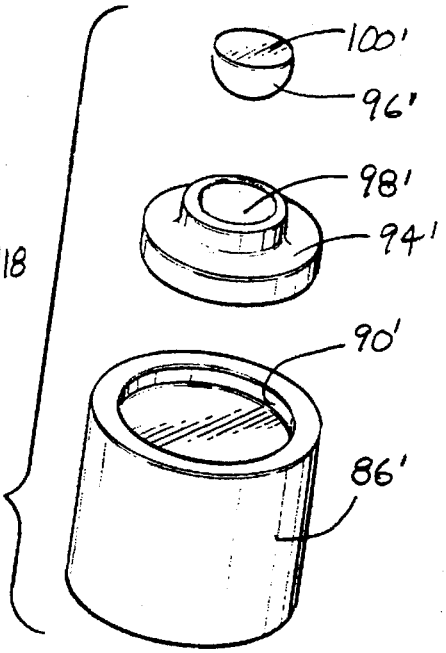
FIG. 5 is an exploded view of the spherical joint employed between each of the rocker arms and the associated inverted bucket tappets seen in FIGS. 2 and 4.
Figure 6:
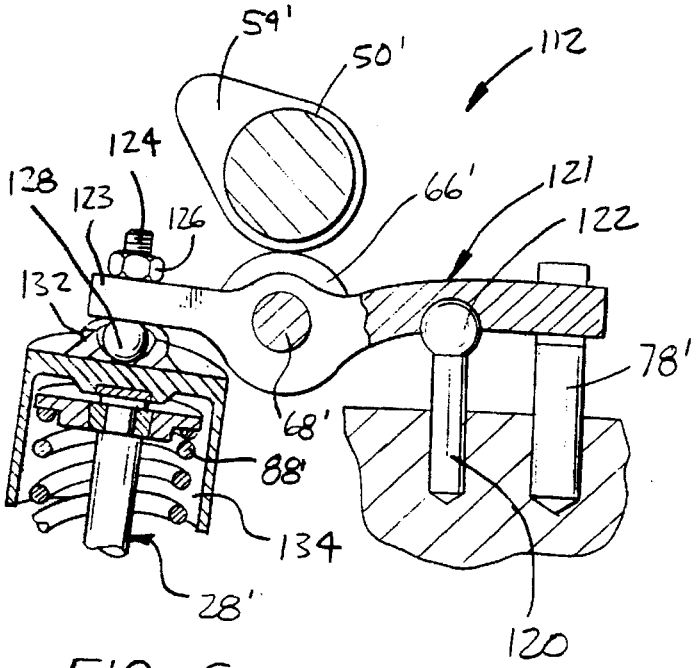
FIG. 6 is a view of another form of spherical joint that can be employed with the valve train arrangement seen in FIG. 2.

FIGS. 4–6 show two modified forms of the valve train mechanism seen in FIG. 2 that can be substituted for the valve train mechanisms 14 or 15 and are generally identified by the reference numerals 110 and 112. It will be noted that those parts of the valve train mechanisms 110 and 112 that identically correspond to parts of the valve train mechanisms 14 or 15 are identified by the same reference numerals but primed.

The valve train mechanism 110 seen in FIGS. 4 and 5 is essentially the same as the valve train mechanism 14 or 15 except that the finger follower 114 has its tail end 116 supported by a shaft 118 for pivotal movement about an axis parallel to the axis of the camshaft 50'. As to the valve train mechanism 112 seen in FIGS. 6 and 7, the hydraulic lash compensator 72 of valve train mechanism 14 is replaced by a rigid ball stud 120 which allows the finger follower 121 to pivot about a ball portion 122. In addition, the head end 123 of the finger follower 121 supports an adjusting screw 124 the shank portion of which is threaded into the head end 123 of the finger follower 121. The adjusting screw 124 is secured to the head end 123 of the finger follower 121 by a locknut 126. In addition, the ball portion 128 of the adjusting screw 124 is located within a spherical recess 130 centrally formed in a socket member 132 located on an inverted bucket tappet 134. In this instance, rather than having a cavity formed in the inverted bucket tappet as provided in the valve train mechanisms 14, 15 and 110, the inverted bucket tappet 134 has a flat top surface 136. As a result, during rocking movement of the finger follower 121, the sliding movement provided by the spherical joint composed of the ball portion of the adjusting screw 124 and the socket member 132 occurs between the top surface 136 of the inverted bucket tappet 134 and the socket member 132 and swivel movement occurs between the ball portion 128 and the socket member 132.

Figure 7:
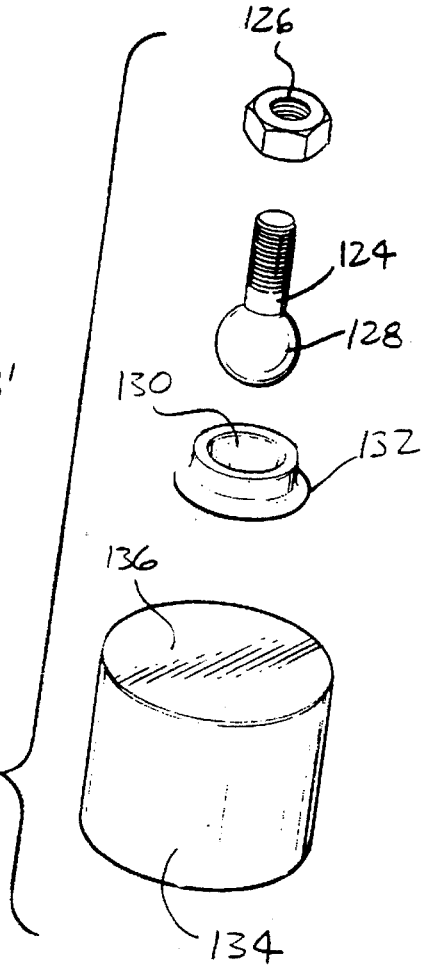
FIG. 7 is an exploded view of the spherical joint seen in FIG. 6.
Figure 8:
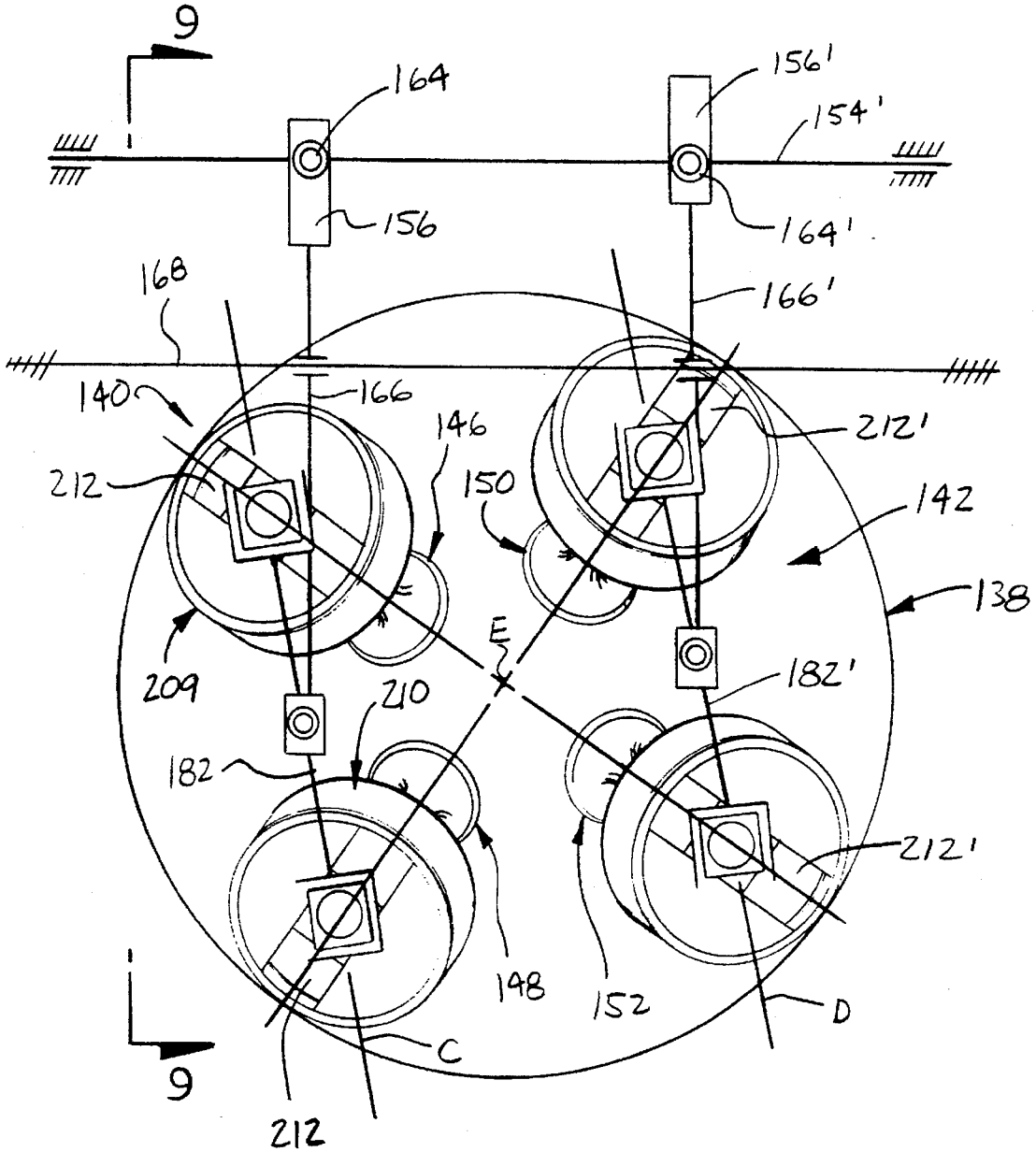
FIG. 8 is a plan view schematic of a modified form of valve train mechanism employing spherical joints and crossheads for use in actuating a multi-valve engine.
Figure 9:
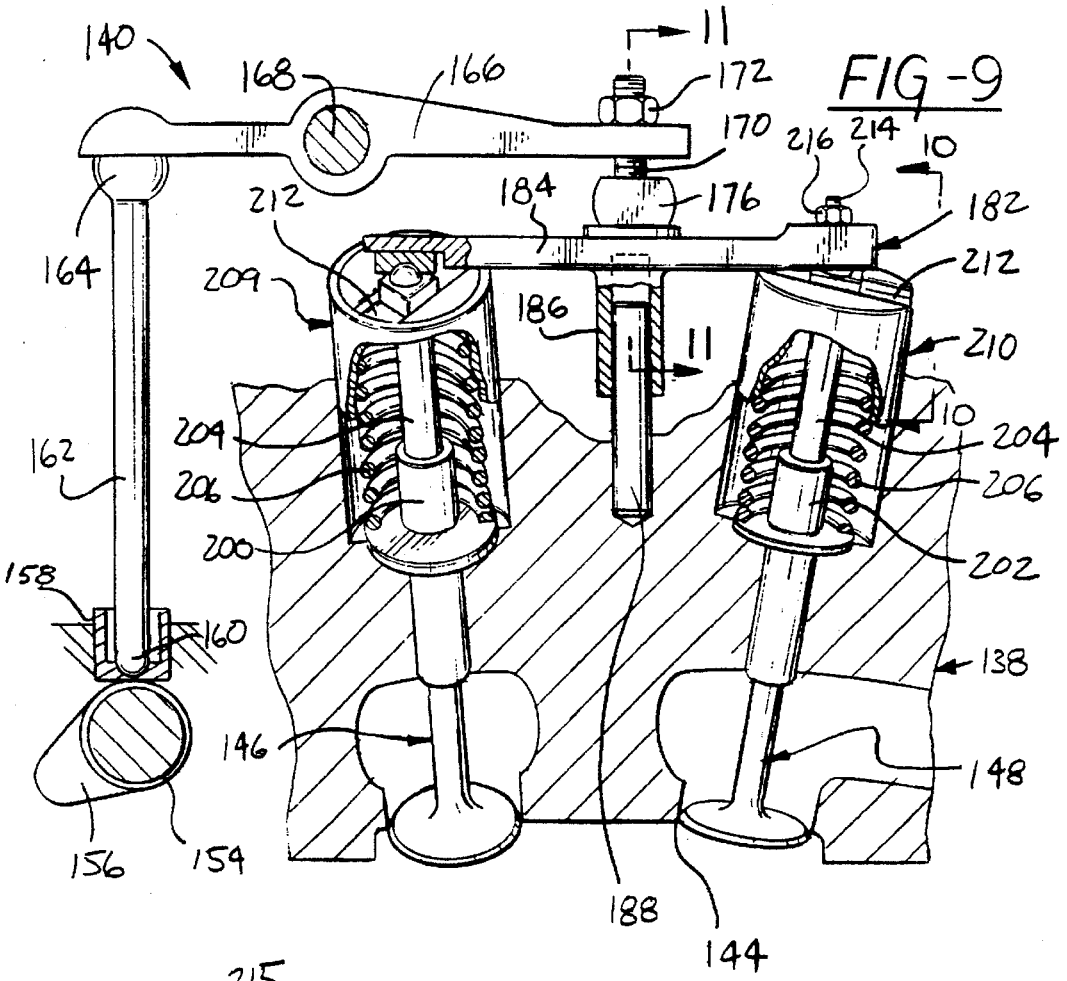
FIG. 9 is a view taken on line 9—9 of FIG. 8 and shows, partially in section, a portion of the cylinder head incorporating the exhaust valves of FIG. 8 and the valve train mechanism for actuating the valves.

FIGS. 8–12 disclose a further modified form of the present invention. FIG. 8 is a schematic diagram in plan view showing one cylinder of a multi-cylinder engine. The engine has an engine block (not shown) on which is secured a cylinder head 138 that incorporates a pair of identical valve train mechanisms 140 and 142. As with the engine seen in FIGS. 1–7, each of the cylinders of the engine house a piston (not shown) which is supported for reciprocal movement along the longitudinal center axis of the associated cylinder. As best seen in FIG. 9, the cylinder head 138 is formed with a hemispherical surface 144 providing a recess which is aligned with the bore defining the associated cylinder (not shown) and together with the top of the piston (not shown) forms a combustion chamber (not shown).

Although FIGS. 9–12 show only the parts of the valve train mechanism 140 which shall hereinafter be described in detail, it will be understood that the valve train mechanism 142 has essentially identical corresponding parts which will be identified in FIG. 8 by the same reference numerals but primed.

As seen in FIG. 8, the cylinder head 138 is provided with a pair of exhaust valves 146 and 148 and a pair of intake valves 150 and 152 which are located in the engine in front-to-rear relationship. The valves 146–152 are equally circumferentially spaced from each other and are inclined so as to have their longitudinal center axes intersect at a point such as point "B" seen in FIG. 1. Also, in this case, rather than having the valves 146–152 actuated by overhead camshafts as with the engine of FIGS. 1–7, the valves 146–152 are actuated by an in-block camshaft 154 the rotational axis of which is parallel to the rotational axis of the crankshaft of the engine incorporating the valves 146–152. In addition, as seen FIG. 8, a line "C" interconnecting the centers of the upper ends of the exhaust valves 146 and 148 and a parallel line "D" interconnecting the centers of the upper ends of the intake valves 150 and 152 each lie in a vertical plane which intersects the rotational axis of the camshaft 154 at an angle.

Thus, as seen in FIG. 9, as the camshaft 154 rotates in timed sequence to the associated engine crankshaft, the cam lobe 156 causes upward movement of a main tappet 158 which is supported for sliding movement by the engine block. Conventionally disposed within the main tappet 158 is a ball and socket joint 160 having its ball portion integrally formed with the lower end of a pushrod 162. A similar ball and socket joint 164 is provided at the upper end of the pushrod 162 for connecting the pushrod 162 to one end of a rocker arm 166 which is supported for oscillation by a shaft 168 having its axis of rotation parallel to the axis of rotation of the camshaft 154.

Figure 10:
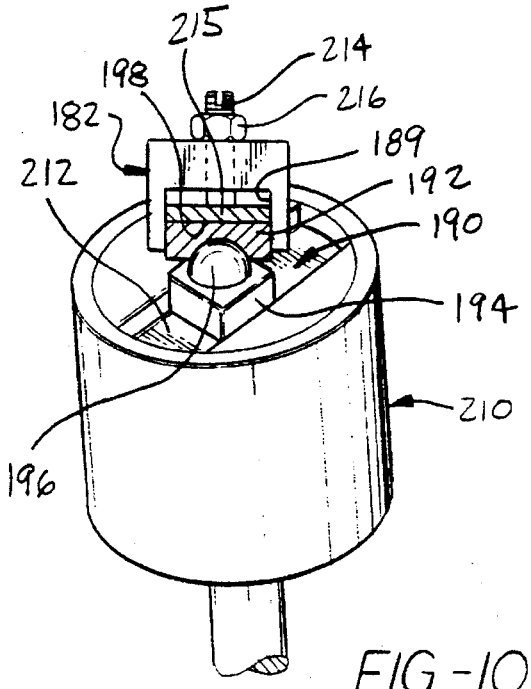
FIGS. 10 and 11 are views taken on line 10—10 and line 11—11, respectively of FIG. 9.
Figure 11:
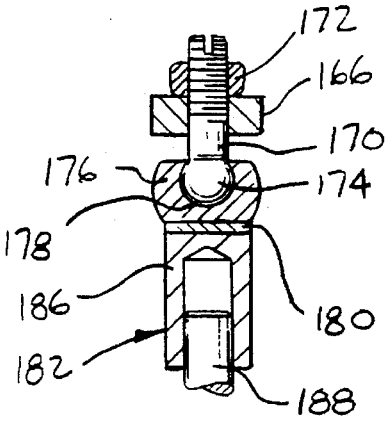

As seen in FIGS. 9 through 11, the other end of the rocker arm 166 has a conventional adjusting screw 170 threaded therein which is secured in place by a locknut 172 threadably received by the upper end of the screw 170. The lower end of the adjusting screw 170 is integrally formed with a ball member 174 which is located in a socket member 176 so as to provide a swivel joint having a flat bottom surface 178 in contact with a hard wear pad 180 securely fixed to the top portion of a "T" bridge or crosshead 182. The crosshead 182 includes a cross member 184 the midsection of which is integrally formed with a depending sleeve 186 supported for slidable up-and-down movement by a guide pin 188 the lower end of which is press-fitted in the cylinder head 12. Each end of the cross member 184 is provided with a longitudinally extending guide slot 189 rectangular in cross section which accommodates one part of a three-part spherical joint 190. Each of the spherical joints 190 includes a top socket member 192, a bottom socket member 194, and a spherical ball 196 therebetween. Thus, as seen in FIGS. 10 and 12, the top socket member 192 of each spherical joint 190 is capable of sliding along the longitudinal axis of the cross member 184.

As seen in FIGS. 8 through 11, the rocker arm 166, the longitudinal center axis of the pushrod 162, and the longitudinal center axis of the guide pin 188 are located in a plane which is perpendicular to the rotational axis of the camshaft 154. Also, a flat surface 198 in each of the guide slots 189 in the cross member 184 that is engaged by the top socket member 192 lies in a plane that is perpendicular to the aforementioned plane passing through the guide pin 188, the pushrod 162, and the rocker arm 166.

As seen in FIG. 9, the cylinder head 138 is formed with valve guides 200 and 202 which guide the valve stems 204 of the exhaust valves 146 and 148 through the course of motion between their fully-closed position and their fully-open position. In addition, each valve 146 and 148 is provided with a valve spring 206 which biases the associated valve into the fully-closed position.

As seen in FIG. 10 and 12, each valve spring 206 has the upper end thereof engaging a disk type retainer 207 secured to the associated valve stem by a two-piece retainer lock 208 and has the lower end of the valve spring in contact with a flat surface (not shown) of the cylinder head 138. Also, the upper tips of the valve stems 204 of the valves 146 and 148 abut inverted bucket tappets 209 and 210, respectively, each of which is slidably disposed within a tappet guide formed as a structural extension of the cylinder head 138. The top of each of the inverted bucket tappets 209 and 210 is formed with a straight flat groove 212 machined therein. As an alternative, the top of each of the inverted bucket tappets 209 and 210 can be formed with a circular cavity (such as provided in the inverted bucket tappet seen in FIGS. 4 and 5) and have a hardened shim located therein with a groove (such as groove 212) formed in the top of the shim.

Each of the grooves 212 is defined by a flat lower surface bounded by a pair of parallel side walls. Slidably disposed within the groove 212 of the hardened shim located on the inverted bucket tappet 209 is the bottom socket member 194 of the associated spherical joint 190 seen in FIG. 12. Similarly, as seen in FIG. 10, slidably disposed within the groove 212 formed in the inverted bucket tappet 210 is the bottom socket member 194 of the associated spherical joint 190. Also as seen in FIG. 10, the one arm of the cross member 184 is provided with an adjusting screw 214 threaded in the arm with the lower end in contact with a wear pad 215 which, in turn, is in contact with top socket member 192. The screw 214, serves to adjust the valve-to-valve height. Once the adjustment is made by rotating the adjusting screw in one direction or the other, a lock nut 216 is tightened to maintain the adjustment. It will be noted that as seen in FIG. 8, the center longitudinal axis of each of the grooves 212 in the inverted bucket tappets 209 and 210 as well as the corresponding grooves 212' of the inverted bucket tappets of the intake valves 150 and 152 intersect at the a point "E" which is located at the center of the associated cylinder.

Thus, as seen in FIG. 9 and 10, it should be apparent that as the camshaft 154 rotates to raise the pushrod 162 and cause the rocker arm 166 to move the cross head 182 downwardly to open the exhaust valves 146 and 148 against the bias of the springs 206, the bottom socket member 194 of each of the spherical joints 190 associated with valves 146 and 148 will slide within their associated grooves 212 as the center distances of the valves change due to the angularity between their respective axes of motion. At the same time, the top socket member 192 of each of the spherical joints 190 associated with valves 146 and 148 will slide within its associated guide slot formed in the opposed arms of the cross member 184. With this arrangement as seen in FIG. 8, the bottom socket member 194 slides radially outwardly relative to the groove 212 of the associated inverted bucket tappet while the top socket member 192 provides for inward axial motion along the axis of the crosshead 182 as the exhaust valves 146 and 148 reciprocate. In addition, the spherical joints 190 cooperate with the associated grooves in the tappets for preventing the crosshead 182 from pivoting about the axis of the guide pin 188. Also, this arrangement eliminates side loading on the valves inasmuch as all of the side loading is taken by the inverted bucket tappets and the guide pin 188. A small amount of sliding friction is taken by the opposed arms of the crosshead 182, by the guide pin 188, and by the inverted bucket tappets. These frictional forces are essentially the same as those experienced by rocker arms operating valves directly except that the unit loads are lower because the loaded areas are in surface-to-surface contact (rather than line contact as on some rocker arms) so as to increase the duration of hydrodynamic lubrication.

FIGS. 13 and 14 disclose a modified form of spherical joint which can be used with the valve train mechanisms 140 and 142 seen in FIGS. 8–12. Accordingly, the parts associated with the exhaust valves seen in FIGS. 13 and 14 that correspond to the parts associated with the exhaust valves of the valve train mechanisms 140 and 142 will be identified by the same reference numerals but double primed. Also, the parts associated with the intake valves seen in FIGS. 13 and 14 that correspond to the parts associated with the intake valves of the valve train mechanisms 140 and 142 will be identified by the same reference numerals but triple primed.

As alluded to above, the only difference between the parts of the valve train mechanisms 140 and 142 and the corresponding parts seen in FIGS. 13 and 14 is the type of spherical joints that are used in the valve train system. For example, instead of using the three-part spherical joint 190 at the opposed ends of the cross heads 182" and 182''', one end of each cross head 182" and 182''' uses a spherical joint 217 seen in FIG. 14 and the other end of each of the cross heads uses a spherical joint 218 which is identical to the spherical Joint seen in FIG. 6 composed of the adjusting screw 124, lock nut 126, and the socket member 132.

More specifically, as seen in FIG. 14, each of the spherical joints 217 includes a half-ball member having an integral upwardly extending tongue composed of a pair of spaced flat and parallel side walls 220 and 222 and a flat top wall 224 which is located in a plane normal to the associated side walls 220 and 222. The half-ball member also includes a spherical lower surface 226. The top tongue portion of the half-ball is slidably received by a slot 228 which extends along the longitudinal axis of the cross head 182'''. On the other hand, the lower surface 226 is positioned within a spherical recess 230 formed in a generally square socket member 232 which, in turn, is located in the groove 212''' formed in the top of the associated inverted bucket tappet. (Note that, as previously mentioned, the top of the inverted bucket tappet can be formed with a cavity in which a hardened shim can be located and formed with a groove for slidably accommodating the socket member of the spherical joint.) As with the valve train mechanisms 140 and 142, the longitudinal center axes of the grooves 212" and 212''' can intersect at a point "F" which is located at the longitudinal center axis of the associated cylinder.

Each of the spherical joints 218 is composed of an adjusting screw, a lock nut, and a socket member such as seen in FIGS. 6 and 7 and identified by reference numerals 124, 126 and 132, respectively. The adjusting screw is threaded into one end of the crosshead 182" and another adjusting screw is threaded into one end of the cross head 182''' with each adjusting screw having its ball portion (not shown) located in a spherical recess centrally formed in the associated socket member. The socket member has a flat bottom which slidably rests on the top surface of the associated inverted bucket tappet in the manner as hereinbefore explained in connection with FIGS. 6 and 7.

Finally, it will be noted that during reciprocation of the crossheads 182" and 182"', the engagement of the socket members 232 within the accommodating grooves 212" and 212"' prevents the crossheads from rotating about their associated guide pins.

With further reference to the spherical joint 217 seen in FIGS. 13 and 14, it will be understood that the tongue portion of the half-ball member could be a separate member which would be fixed to and extend downwardly from the end of the cross member. In such case a groove formed in the top surface (such as surface 100' seen in FIG. 5) of the half-ball member would have a groove formed therein which would slidably accommodate the tongue portion fixed to the end of the cross member.

Various changes and modifications can be made to the above described valve train mechanism without departing from the spirit of the invention. Such changes are contemplated by the inventor and he does not wish to be limited except by the scope of the appended claims.

The embodiments of the invention in which an exclusive property or privilege is claimed are defined as follows:

1. A valve train mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine and being defined by a recess in said cylinder head and the top of said piston, at least a pair of valves located in said cylinder head, each of said valves being inclined outwardly from said combustion chamber at substantially equi-angular orientation relative to said axial center line, an inverted bucket tappet mounted on the upper end of each of said valves, a camshaft, an actuator member operated by said camshaft for moving each of said valves to an open position, a spherical joint assembly comprising a ball member and at least one socket member, said spherical joint assembly being located between said actuator member and the top of said inverted bucket tappet, and a flat surface-to-surface sliding connection provided by one of said ball member and said at least one socket member between said actuator member and said top of said inverted bucket tappet for assuring that said actuator member maintains a force applying connection with said inverted bucket tappet as said actuator moves said valve to said open position, wherein said actuator is formed with an elongated slot and said ball member is configured as a half-ball and is formed with a pair of laterally spaced side walls slidably located in said slot.

2. The valve train mechanism of claim 1 wherein the top surface of said inverted bucket tappet is formed with a groove and said socket member is slidably located in said groove.

* * * * *